US007500715B1

(12) United States Patent
Chen

(10) Patent No.: US 7,500,715 B1
(45) Date of Patent: Mar. 10, 2009

(54) BEACH CHAIR WITH SIMPLE LOCKING MEANS

(76) Inventor: Libin Chen, Qiaoyu building, West of Boyi Town, Changzhou, Jiangsu Province (CN) 213147

( * ) Notice: Subject to any disclaimer, the term of this patent is extended or adjusted under 35 U.S.C. 154(b) by 11 days.

(21) Appl. No.: 11/907,540

(22) Filed: Oct. 15, 2007

(51) Int. Cl.
*A47C 1/035* (2006.01)

(52) U.S. Cl. ..... 297/27; 297/35; 297/359

(58) Field of Classification Search ..... 297/27, 297/28, 35, 359; 248/188.5; 403/104, 109.5
See application file for complete search history.

(56) References Cited

U.S. PATENT DOCUMENTS 2,571,463 A * 10/1951 Lorenz ..... 297/29
4,185,936 A * 1/1980 Takahashi ..... 248/188.5
4,430,017 A * 2/1984 Stefancich ..... 403/104
4,536,031 A * 8/1985 Latone ..... 297/353
4,596,484 A * 6/1986 Nakatani ..... 403/104
4,761,092 A * 8/1988 Nakatani ..... 248/188.5
5,464,270 A * 11/1995 Chang ..... 297/68
6,142,699 A * 11/2000 Pao ..... 403/109.5
2003/0164626 A1 * 9/2003 Lardieri et al. ..... 297/35

* cited by examiner

*Primary Examiner*—Peter R. Brown

(57) ABSTRACT

A beach chair has a supporting means, a pivotal means fixed to the supporting means, a frame installed on the pivotal means and swayable with respect to the supporting means, a pair of armrest supports pivotally installed on the supporting means, and a cushion supported on the frame. The frame has a seat frame, a back frame fixed to the seat frame, and a leg frame pivotally fixed to the seat frame. An armrest support has a tube having a front end and a rear end, a pin support for pivotally installing the armrest support to the supporting means, a lock chamber, and an armrest installation surface; and a locking means having a handle, a pressing sleeve, and a pin.

4 Claims, 5 Drawing Sheets

BEACH CHAIR WITH SIMPLE LOCKING MEANS

BACKGROUND OF THE INVENTION

1. Field of the Invention

The invention relates to a beach chair, and more especially, to a beach chair with a locking means which is simple.

2. Description of the Prior Art

Beach chairs an angle of a back thereof being adjustable have long been developed. When a user selects an angle he need, a position of the beach chair needs to be locked. A conventional locking means generally consists of a bolt which is able to be rotated to tightly press on a slidable tube to stop the tube moving with respect to a body of the beach chair. The position of the beach chair is thus locked. However, such locking means has some drawbacks. For example, in order to make the locking secure, the user has to rotate the bolt with his hand forcefully. It is painstaking and may hurt his hand. Sometimes it cannot be completed by a child. Furthermore, such means is liable to loose. And, this means is relatively complex in structure and thus will bring high cost in manufacturing.

BRIEF SUMMARY OF THE INVENTION

The main object of the invention is to provide a beach chair having a simple locking means.

In accordance with one aspect of the invention, there is provided a beach chair having a supporting means, a pivotal means fixed to the supporting means, a frame installed on the pivotal means and swayable with respect to the supporting means, a pair of armrest supports pivotally installed on the supporting means, and a cushion supported on the frame. The frame has a seat frame, a back frame fixed to the seat frame, and a leg frame pivotally fixed to the seat frame. An armrest support has a tube having a front end and a rear end, a pin support for pivotally installing the armrest support to the supporting means, a lock chamber, and an armrest installation surface; and a locking means having a handle, a pressing sleeve, and a pin.

These and other objectives, features, and advantages of the present invention will become apparent from the following detailed description, the accompanying drawings, and the appended claims.

DETAILED DESCRIPTION OF THE PREFERRED EMBODIMENT

Figure 1:
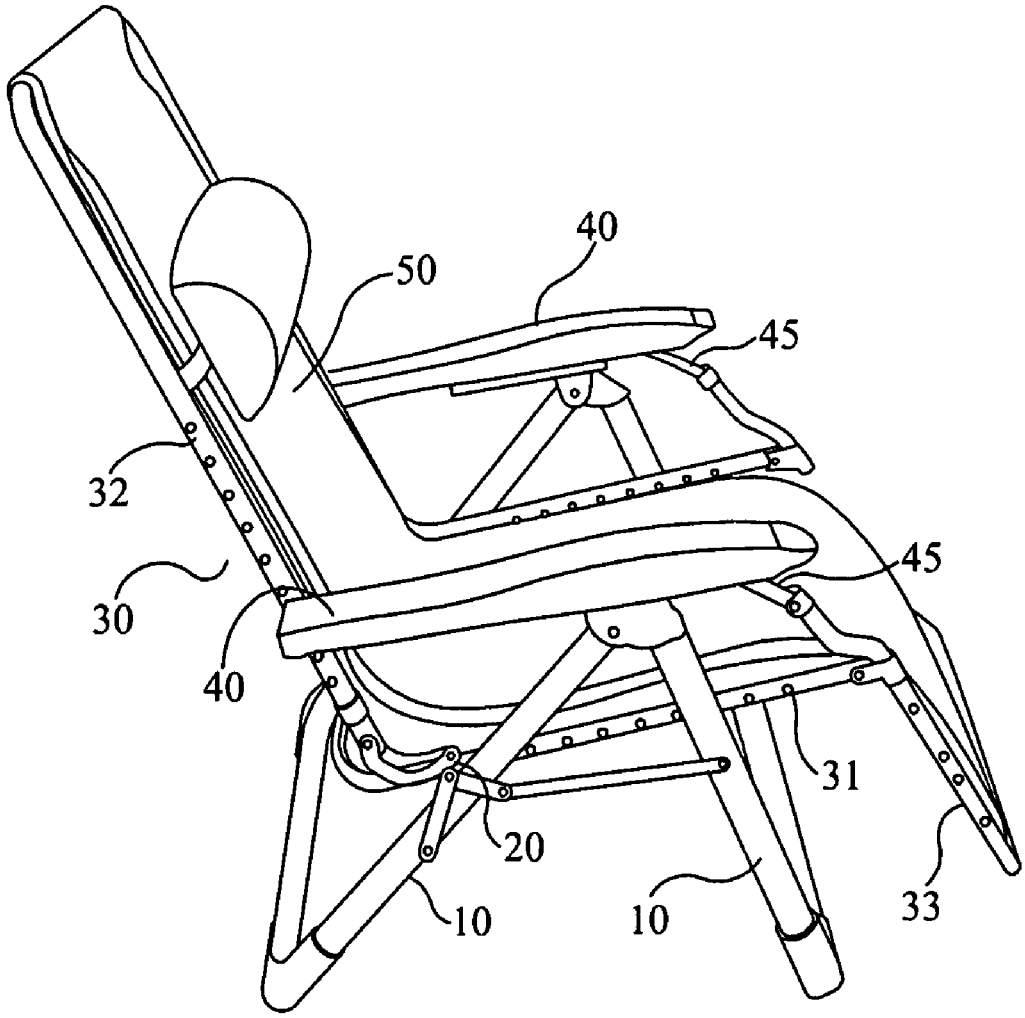
FIG. 1 is a schematic perspective view of a preferred embodiment of the beach chair of the invention.

As shown in FIG. 1, a beach chair of the invention has a supporting means 10, a pivotal means 20 fixed to the supporting means 10, a frame 30 being installed on the pivotal means 20 and swayable with respect to the supporting means 10, a pair of armrest supports 40 pivotally installed on the supporting means 10, and a cushion 50 supported on the frame 30. The frame 30 has a seat frame 31, a back frame 32 fixed to the seat frame 31, and a leg frame 33 pivotally fixed to the seat frame 31.

Figure 2:
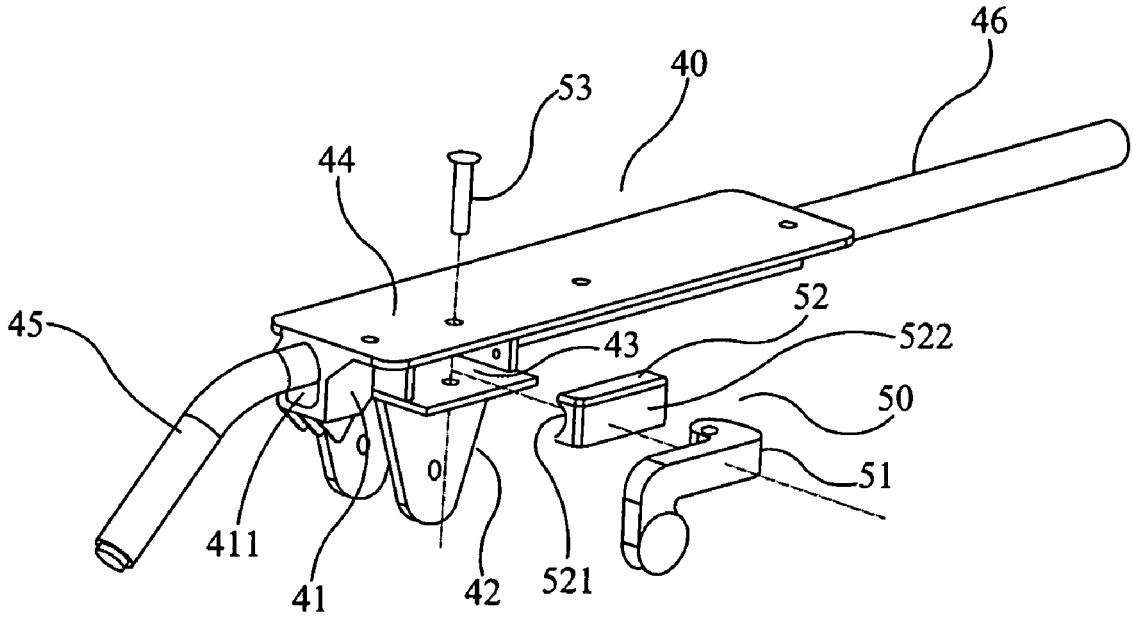
FIG. 2 is an exploded view showing an armrest support of the beach chair of the invention.

With reference to FIG. 2, the armrest support 40 has a tube 41 having a front end 411 and a rear end (not shown), a pin support 42 for pivotally installing the armrest support 40 to the supporting means 10, a lock chamber 43, and an armrest installation surface 44. A front linking pole 45 is pivotally installed on the leg frame 33 at one end thereof and inserted into the front end 411 of the tube 41 of the armrest support 40 at a free end thereof. The front linking pole 45 is able to slide in the tube 41. A rear linking pole 46 is pivotally installed on the back frame 32 at one end thereof and inserted into the rear end of the tube 41 of the armrest support 40 at a free end thereof. A locking means 50 has a handle 51, a pressing sleeve 52, and a pin 53. The pressing sleeve 52 has a curved inner surface 521 and an opposite flat outer surface 522.

Figure 3:
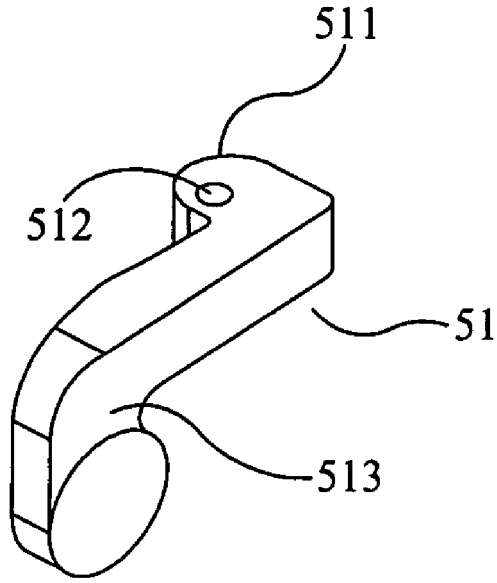
FIG. 3 is a schematic perspective view showing a handle of the invention.
Figure 4:
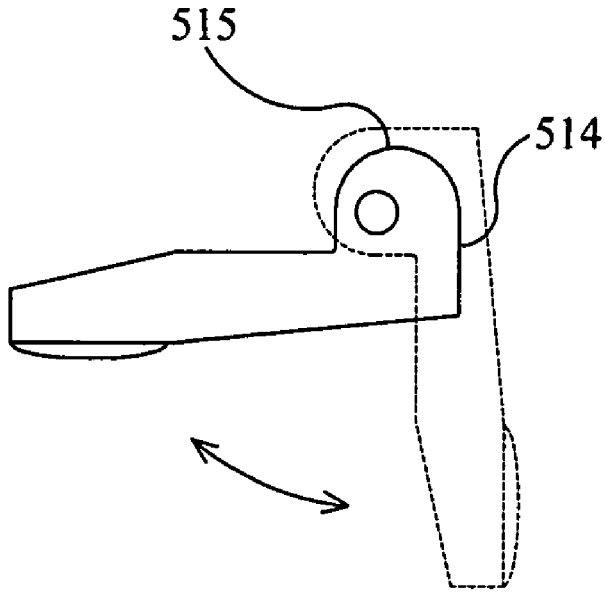
FIG. 4 is a top view showing the relative positions when the handle is opened and closed.

Further with reference to FIGS. 3 and 4, the handle 51 has a flange 511, a hole 512 defined in the flange 511, and a lever 513. In installation, the pressing sleeve 52 is able to be inserted into the lock chamber 43 until the inner surface 521 meets the free end of the front linking pole 45. And then the flange 511 of the handle 51 is able to be put into the lock chamber 43. The pin 53 is finally inserted into an opening defined in the lock chamber 43 and goes through the hole 512. The handle 51 is able to rotate around the pin 53.

Figure 5:
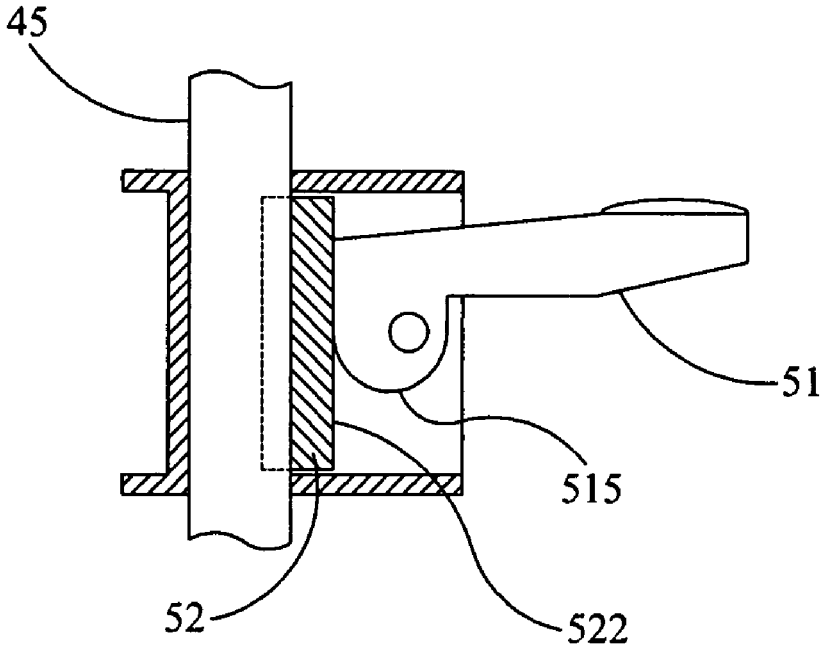
FIG. 5 is a schematic perspective view of the beach chair shown in FIG. 1 showing a closed position of a handle of a locking means.
Figure 6:
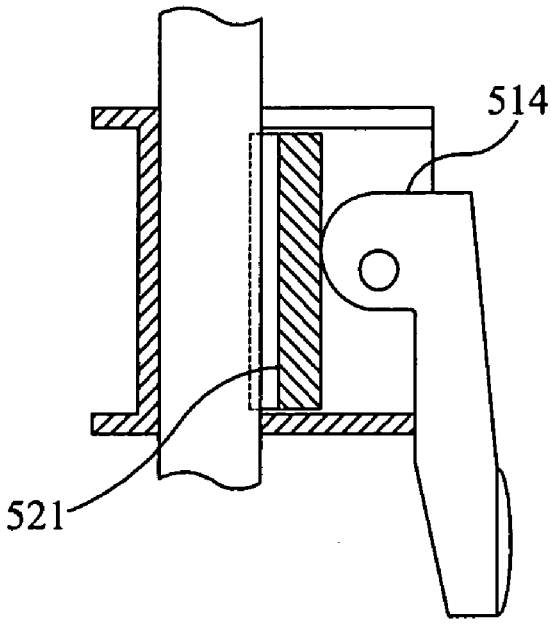
FIG. 6 is a schematic perspective view of the beach chair shown in FIG. 2 showing an opened position of the handle.
Figure 7:
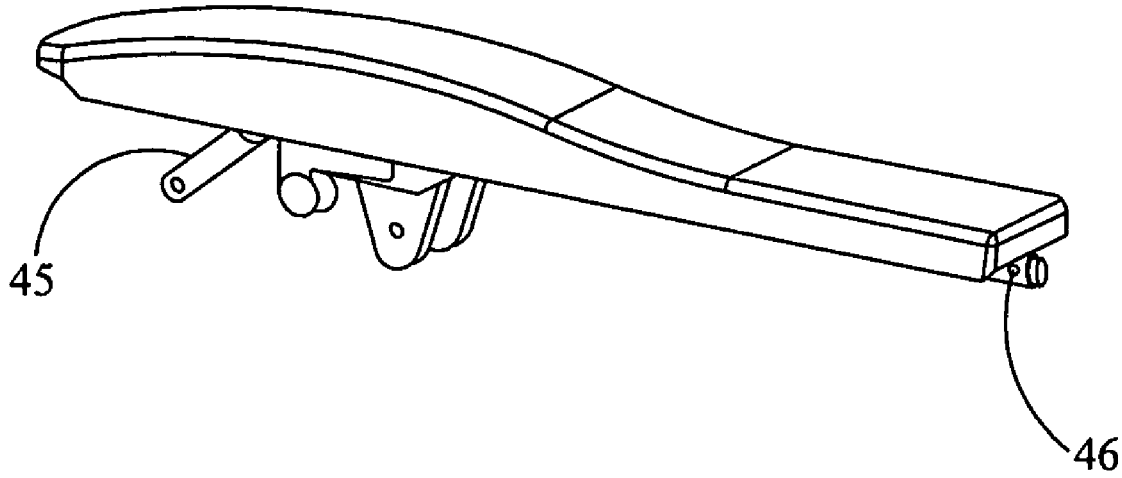
FIG. 7 is a partial and schematic view showing the opened position of the handle with an armrest is installed; and, FIG. 8 is a partial and schematic view showing the closed position of the handle with the armrest is installed.
Figure 8:
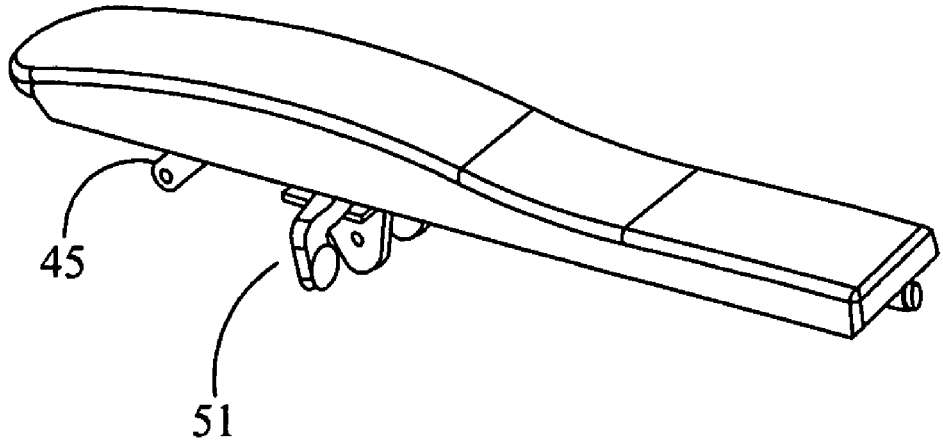

In use, a user is able to sit on the beach chair of the invention and move his body, making the frame 30 rotate around the pivotal means 20, to select a preferred position of the frame 30, and then push the lever 513 of the handle 51 to a closed position as shown in FIG. 5. In this position, a closed surface 514 will forcefully press on the outer surface 522 of the pressing sleeve 52. The friction between the inner surface 521 of the pressing sleeve 52 and the free end of the front linking pole 45 will stop the front linking pole 45 sliding with respect to the armrest support 40. The frame 30 is not able to sway around the pivotal means 20 any longer. When the user needs to adjust the position, he can push the lever 513 of the handle 51 in the direction A as shown in FIG. 5 to an opened position as shown in FIG. 6. In this position, an opened surface 515 will not forcefully press on the outer surface 522 of the pressing sleeve 52. The free end of the front linking pole 45 is thus able to slide with respect to the armrest support 40. The user is able to select a new preferred position of the frame 30 and then close the handle 51 again. FIG. 7 is a partial and schematic view showing the opened position of the handle with an armrest is installed, and FIG. 8 is a partial and schematic view showing the closed position of the handle with the armrest is installed.

One who is skilled in the art will understand that the aforementioned embodiment of the invention as shown in the drawings and described above is for example only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A beach chair comprising:

a supporting means;

a pivotal means fixed to said supporting means;

a frame installed on said pivotal means and swayable with respect to said supporting means around said pivotal means, said frame having a seat frame, a back frame fixed to said seat frame, and a leg frame pivotally fixed to said seat frame;

a pair of armrest supports pivotally installed on said supporting means, each of said armrest supports having a tube having a front end and a rear end, a pin support for pivotally installing said armrest support to said supporting means, a lock chamber, and an armrest installation surface;

a front linking pole pivotally installed on said leg frame at one end thereof and being slidably inserted into a front end of said tube of said armrest support at a free end thereof;

a rear linking pole pivotally installed on said frame at one end thereof and inserted into said rear end of said tube of said armrest support at a free end thereof; and, a locking means having a handle having a flange, a hole defined in said flange and a lever for pressing, a pressing sleeve contained in said lock chamber and having an inner surface being able to meet said free end of said front linking pole and an outer surface being able to meet said flange, and a pin going through said hole in said flange, said flange having a closed surface which is able to forcefully press on said outer surface of said pressing sleeve when said lever of said handle is pushed to a closed position and an open surface which is able to leave said outer surface of said pressing sleeve when said lever of said handle is pushed to an opened position.

2. The beach chair as claimed in claim 1, wherein said beach chair has a cushion supported on said frame.

3. The beach chair as claimed in claim 2, wherein said inner surface of said pressing sleeve is curved and said outer surface of said pressing sleeve is flat.

4. The beach chair as claimed in claim 1, wherein said inner surface of said pressing sleeve is curved and said outer surface of said pressing sleeve is flat.

* * * * *